US005468528A

United States Patent [19]

Schnaars et al.

[11] Patent Number: 5,468,528

[45] Date of Patent: Nov. 21, 1995

[54] BULK BAG WITH INTERNAL BAFFLES

[76] Inventors: Daniel R. Schnaars, 402 Harwel Dr., Lafayette, La. 70503; Randall H. Curtis, 208 C Dublin Cir., Lafayette, La. 70506

[21] Appl. No.: 403,566

[22] Filed: Mar. 14, 1995

Related U.S. Application Data

[63] Continuation of Ser. No. 164,207, Dec. 9, 1993, abandoned.

[51] Int. Cl.[6] ..... B65D 30/10; B65D 33/02; B65D 33/14

[52] U.S. Cl. ..... 428/35.7; 428/36.1; 383/107; 383/13; 383/119; 383/22; 383/17; 383/41; 383/67; 383/109; 383/116

[58] Field of Search ..... 428/35.7, 36.1; 383/107, 13, 119, 22, 17, 41, 67, 109, 116

[56] References Cited

U.S. PATENT DOCUMENTS

| | | | |
|---|---|---|---|
| 4,946,291 | 8/1990 | Schnaars | 383/113 |
| 5,076,710 | 12/1991 | Derby | 383/22 |
| 5,165,802 | 11/1992 | Derby | 383/22 |
| 5,203,633 | 4/1993 | Derby | 383/17 |
| 5,222,812 | 6/1993 | Cuddy et al. | 389/17 |

*Primary Examiner*—George F. Lesmes

*Assistant Examiner*—Kathleen L. Choi

*Attorney, Agent, or Firm*—Pravel, Hewitt, Kimball & Krieger

[57] ABSTRACT

A bulk material transport bag has a plurality of sidewalls, a lower end wall, and an upper wall, defining a bulk material space therewithin. The surrounding sidewalls are formed by a panel of fabric, positioned at each corner of the bag, the panel of fabric formed into a right triangle, so that the first and second legs of the triangle form the outer wall of the bag at each corner, and the third leg (or hypotenuse) of the triangle forms the internal baffle wall of the bag. Each corner triangle is stitched to a flat panel of fabric, defining the remaining central portion of each sidewall, so that when the eight portions of fabric are joined, there is defined the enclosed wall of the bag, together with the baffles formed in the interior of the bag. The bag includes a plurality of rectangular or triangular shaped openings in each of the baffle walls for allowing bulk material to flow therethrough in order to completely fill the bag. The baffle walls include fabric portions between each opening to define a means for maintaining the baffle walls intact under the weight of the bulk material. The bag also provides a plurality of lifting loops sewn to straddle each corner of the bag for easy pickup by a forklift. In an alternative embodiment, the bulk bag is provided with a heavy plastic or polyethylene liner insertable in the bag and including the baffle features.

12 Claims, 6 Drawing Sheets

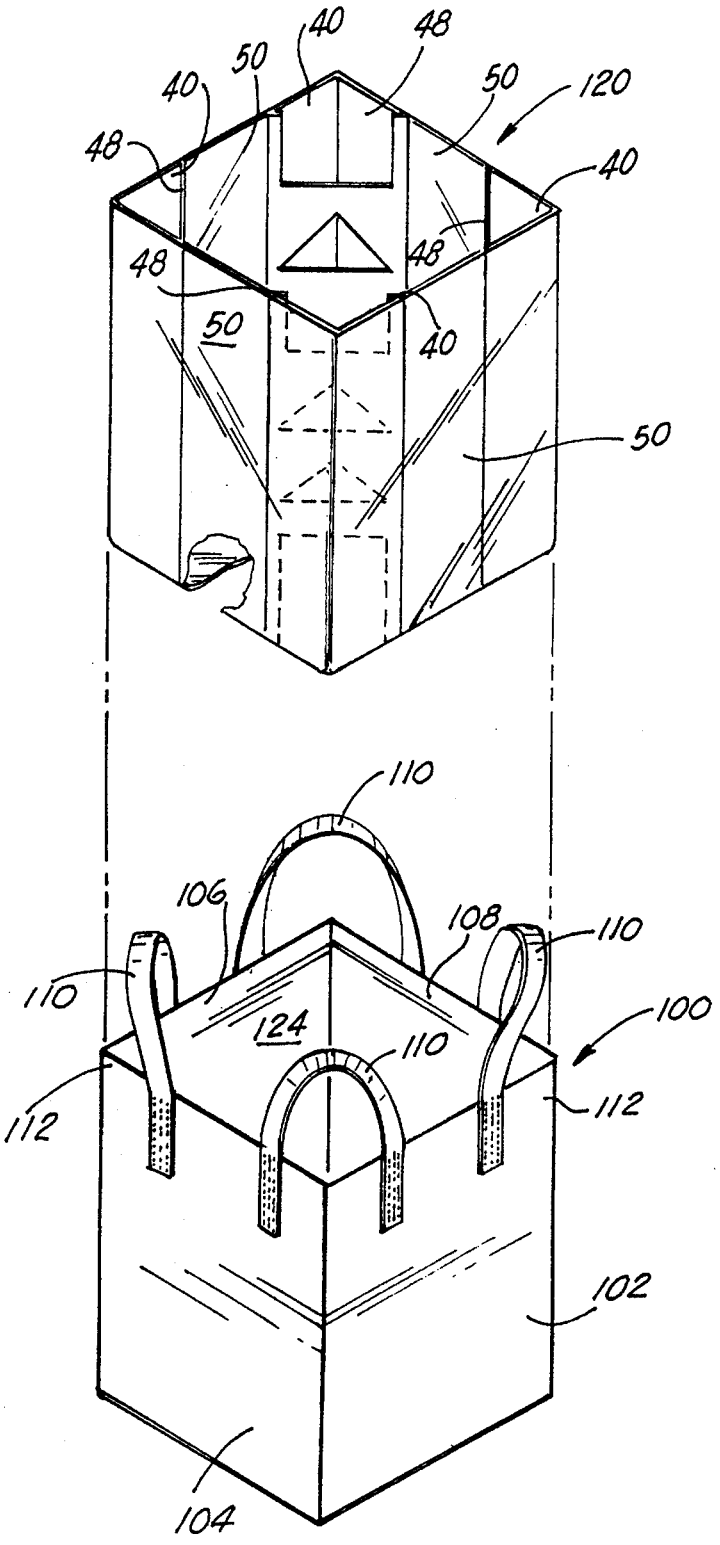
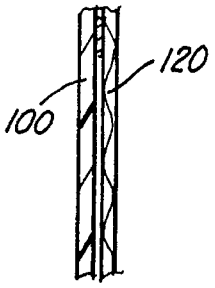
FIG. 10
FIG. 9

BULK BAG WITH INTERNAL BAFFLES

This is a continuation of application Ser. No. 08/164,207 filed on Dec. 9, 1993, now abandoned.

BACKGROUND OF THE INVENTION

1. Field of the Invention

The apparatus of the present invention relates to bulk material transport bags or bulk bags. More particularly, the present invention relates to a bulk material transport bag having a construction which includes baffles on the interior of the bag, so that the bag maintains a relative cubical shape when bulk material has filled the bag.

2. General Background

Dry bulk material is shipped between destinations in large fabric bags, referred to as bulk material transport bags, or in short, bulk bags. Bulk bags, in general, are capable of carrying at least a ton of dry bulk, such as resins or other powdered materials. Generally the bags are formed of fabric material, having four sidewalls, an upper wall, a lower wall, with an inlet spout for introducing material into the bag, and a discharge spout for allowing the material to flow from the bag. The bags, when empty, usually are substantially cubical in shape, and include a lifting loop at each corner so that they may be lifted and moved by forklift. Furthermore, because bulk bags are made of flexible fabric, and they are filled with dry flowable materials, they take the most efficient shape, that of a cylinder. Even though they are made into a square shape, the natural forces of the product force the square into a cylindrical shape. This cylindrical shape creates voids between bags when they are placed into trucks and overseas containers. With some products this loss of space means that the container travels with less than maximum weight allowed. Anytime such a container travels with less than maximum load, shipping costs are unnecessarily high.

In the past, bulk bags were made from a first U-shaped panel of material with two sidewall panels sewn to the legs of the U, and a top portion sewn in to complete the bag. This previous construction requires seams to be in all vertical corners. When baffles are added to this design to maintain the cubicle shape, they are typically attached across the corners. This requires attachment to two separate panels and increased production problems. It is also difficult to attach these panels either before or after the corner seam is to be formed.

One company, Super Sack, Inc. has introduced and patented a bulk bag, under U.S. Pat. Nos. 5,076,710 and 5,165,802, where there is provided six panels of fabric sewn together to form the outer wall of the bag, with the ends of the lifting loops, rather than being attached at the corners, are attached within the four seams of the bag. This patent teaches how to attach baffles to a single panel with reduced labor cost, which create seams in the center of each side. This creates a seam down the center of each side wall of the bag so that stenciling of the company name on the bag wall is difficult due to the passage of the seam.

The shortcoming in the construction of the Super Sack patented bag is that the baffle construction which allows bulk to flow into the space formed by the baffle, by having circular holes cut in the baffle wall, results in stress on the baffle fabric when bulk material is placed in the bag, which results in formation of bulges in the walls of the bag which reduces the space efficiency of the container.

Other prior art teaches the use of baffles within bulk material transport bags, and these are cited in the prior art statement filed herewith.

Other objects of the invention will be obvious to those skilled in the art from the following description of the invention.

SUMMARY OF THE PRESENT INVENTION

The bulk bag construction of the present invention solves the shortcomings in the art in a simple and straightforward manner. What is provided is a bulk material transport bag having a plurality of sidewalls, a lower end wall, and an upper wall, defining a bulk material space therewithin. The surrounding sidewalls are formed by a panel of fabric, positioned at each corner of the bag, the panel of fabric formed into a right triangle, so that the first and second legs of the triangle form the outer wall of the bag at each corner, and the third leg (or hypotenuse) of the triangle forms the internal baffle wall of the bag. Each corner triangle is stitched to a flat panel of fabric, defining the remaining central portion of each sidewall, so that when the eight portions of fabric are joined, there is defined the enclosed wall of the bag, together with the baffles formed in the interior of the bag. There is further provided a plurality of rectangular or triangular shaped openings in each of the baffle walls for allowing bulk material to flow therethrough in order to completely fill the bag, the baffle walls include fabric portions between each opening to define a means for maintaining the baffle walls intact under the weight of the bulk material. The bag also provides a plurality of lifting loops sewn to straddle each corner of the bag for easy pickup by a forklift.

In an additional embodiment a fabric bulk bag would be provided with a heavy plastic or polyethylene liner insertable in the bag and including the baffled features as disclosed in the bag in the principal embodiment of the present invention. The liner would be glued into the outer fabric bag to provide for a contamination-free environment within the bag while offering the structural support of a baffled bulk bag.

Therefore, it is a principal object of the present invention to provide a bulk material transport bag constructed with interior baffles formed from a portion of the exterior wall portion of the bag;

It is a further principal object of the present invention to provide a bulk material transport bag constructed of at least eight panels of fabric stitched together to form the sidewalls of the bag;

It is a further object of the present invention to provide a bulk material transport bag so constructed so as to provide a continuous sidewall surface between seams wide enough to stencil company logos or the like on the side panel;

It is a further object of the present invention to provide a bulk material transport bag which provides that the construction of the interior baffles serve to strengthen the bag and result in a more square bag when filled with bulk material.

It is a further object of the present invention to provide a bulk material transport bag which includes a preformed polyethylene or heavy plastic liner, formed to be glued within a fabric bag, to provide structural integrity to the bag and provide a contamination-free environment for bulk material within the bag.

It is a further object of the present invention to provide a bulk material transport bag which would eliminate the need for a center seam, which makes printing in the proper position impossible, and would eliminate the need for corner seams.

It is a further object of the present invention to provide a bulk material transport bag which allows great flexibility to make various size bags while at the same time making the production of these various sizes constant (i.e creating square or rectangular containers with no changes to the process).

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein:

FIG. 9 illustrates an overall view of an alternate embodiment of the improved baffled bulk bag of the present invention housing a polyethylene baffled liner within the fabric bag portion; and FIG. 10 illustrates a partial view of the polyethylene liner glued to the outer fabric bag in the alternate embodiment of the baffled bulk bag illustrated in FIG. 9.

DETAILED DESCRIPTION OF THE PREFERRED EMBODIMENT

Figure 1:
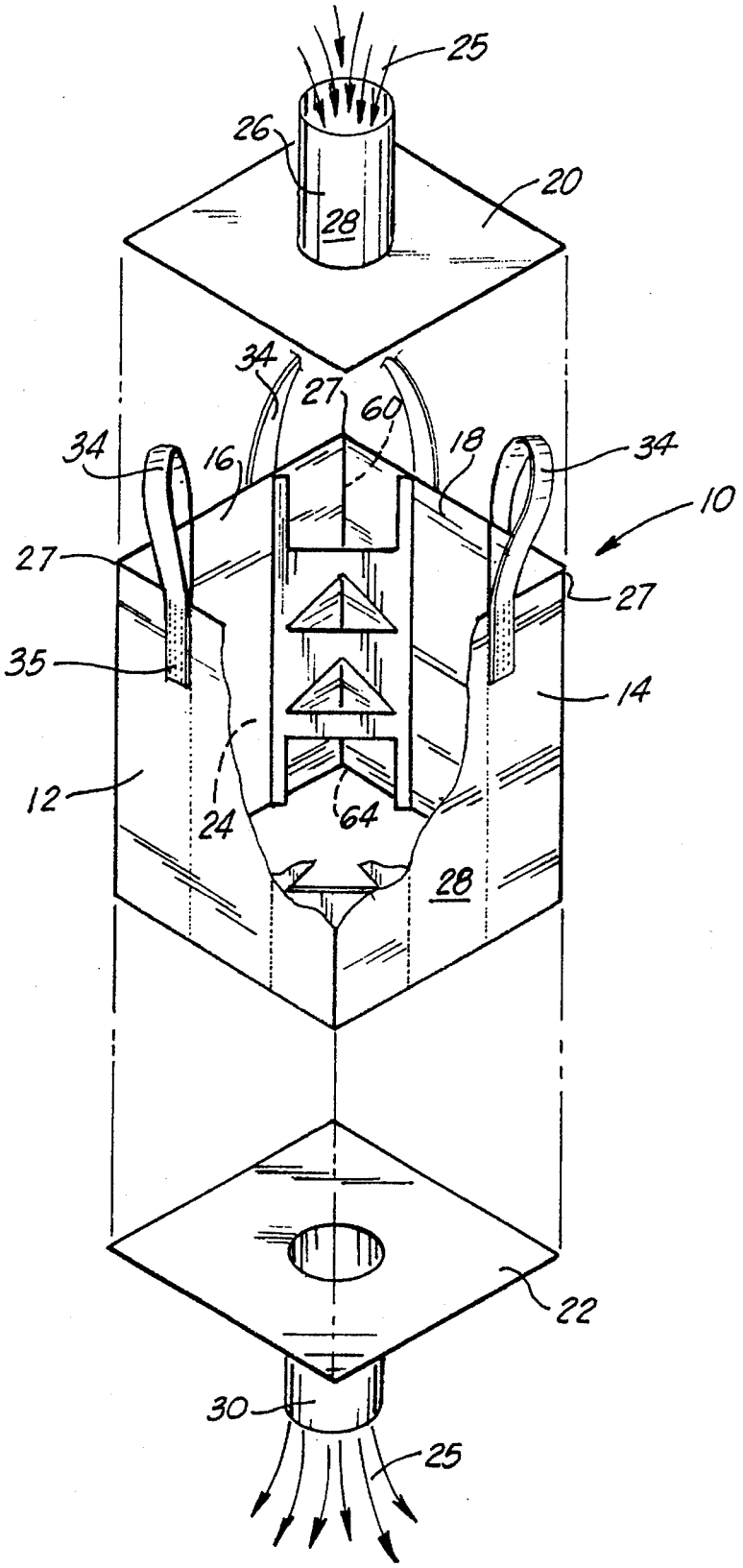
FIG. 1 illustrates an overall exploded view of the preferred embodiment of the improved baffled bulk bag of the present invention.

FIGS. 1 through 8 illustrate the preferred embodiment of the improved baffled bulk bag of the present invention by the numeral 10. As seen in overall exploded view in FIG. 1, bulk bag 10 would comprise a plurality of four generally upright wall portions, 12, 14, 16, 18 , a top portion 20 and a bottom portion 22, all together forming the internal bag space 24 for receiving and storing dry bulk material 25 therein for shipment. As is typical in bulk bags in general, the top portion 20 would further include an entry spout 26, comprising a substantially cylindrical portion of fabric 28, for receiving the bulk material poured 25 into the internal bag space 24. Likewise, the bottom portion 22 includes a discharge spout 30 which would normally be tied closed, but would be opened to allow the bulk material 25 contained within the space 24 to be released from the internal bag space 24 when emptied.

As seen further in FIG. 1, the bag 10 would typically include at least four lifting loops 34, with their end portions 35 sewn at each corner 27 of the bag 10 for allowing the filled bag 10 to be lifted by a forklift, since when filled, such a bag may way as much as 2000 pounds. Although the baffle feature is illustrated in FIG. 1, reference will be made to other figures in order to discuss in detail the baffle feature, together with the sidewall components which generally comprise the novelty in the bag.

Figure 2:
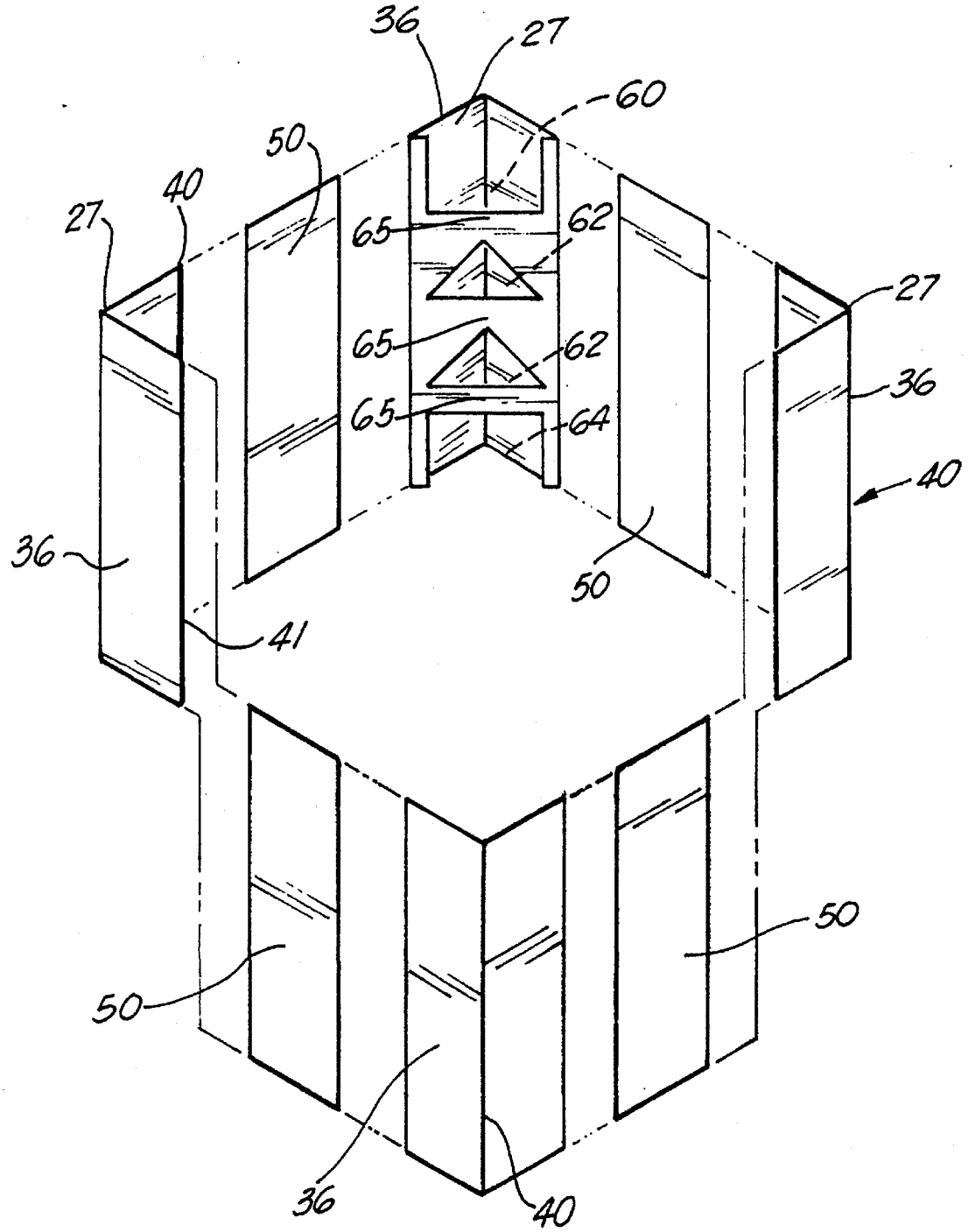
FIG. 2 illustrates an exploded view of the sidewall components of the preferred embodiment of the improved baffled bulk bag of the present invention.
Figure 5:
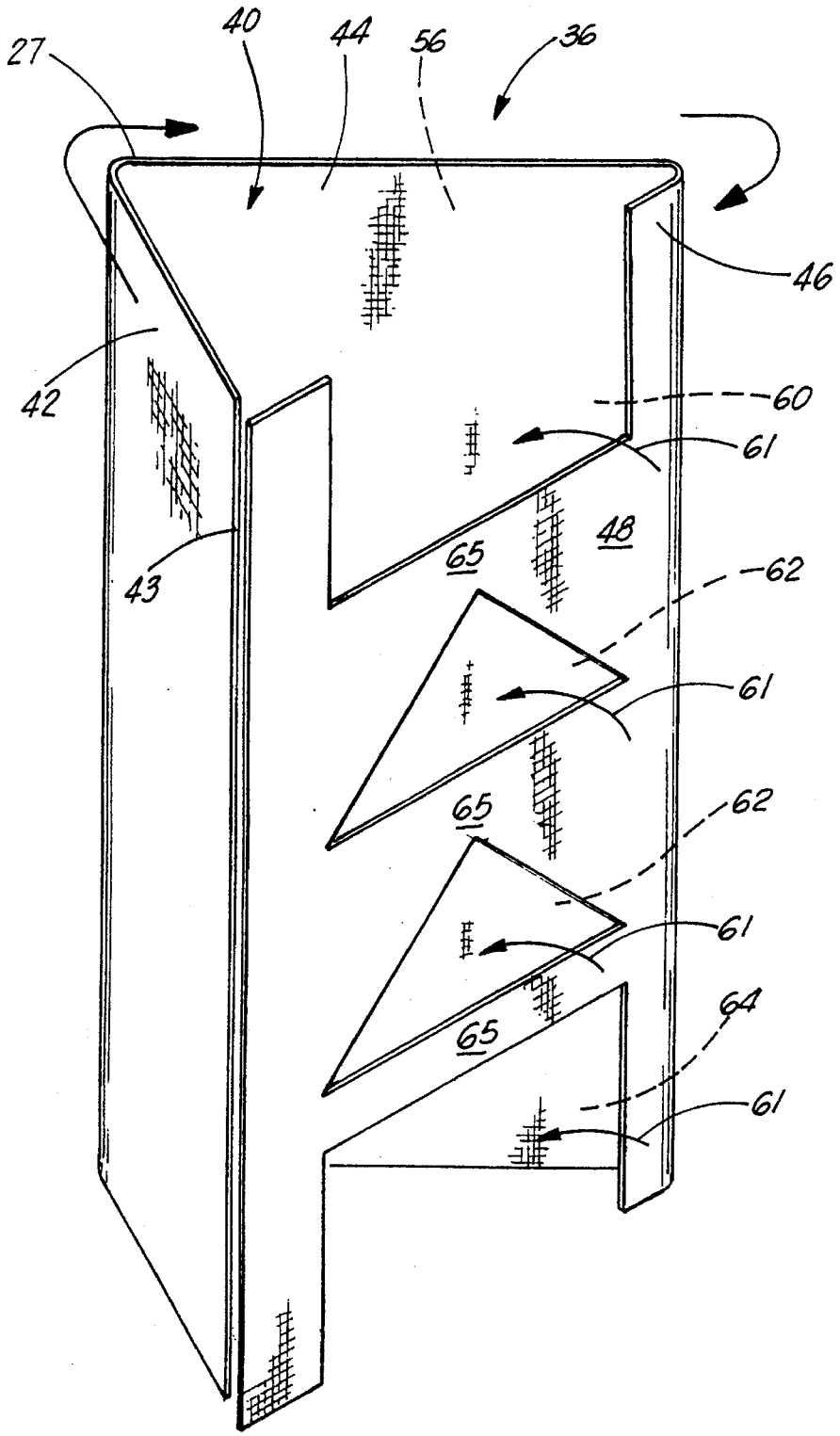
FIG. 5 illustrates an overall view of the corner component and baffle of the preferred embodiment of the improved baffled bulk bag of the present invention.

As seen in exploded view in FIG. 2, the generally rectangular bag 10 comprises a plurality of sidewall components which, when sewn together form the enclosed wall portions 12, 14, 16, 18 of the bag 10. As illustrated, there is provided a first fabric component 36, which comprises a section of fabric, having an overall vertical length and an overall width of approximately 42 inches. The fabric corner component 36 is illustrated in FIG. 5 in detail. For purposes of illustration only a single corner component 36 is illustrated, but it should be made clear that a component 36 is positioned to form each corner component of the bag 10. As illustrated, each fabric component 36 is formed substantially into a triangle 40, with a first leg 42 of the triangle 40 forming a portion of a sidewall (e.g. sidewall 14), a second leg 44 of the triangle 40 forming a portion of adjoining sidewall 16, and the third leg (or hypotenuse) 46 of triangle 40 would be folded inwardly to form the internal baffle wall 48, and would-close off and complete the triangle 40 as seen in FIG. 5.

For purposes of construction, and referring back to FIG. 2, 3, and 4 there is illustrated a triangular fabric component 40 positioned at each corner 27 of the bulk bag 10, so that the four corners of the bag 10 are represented by the triangle components 40. As seen further in FIG. 2, each of the closed triangular components 40 are then interconnected via a seam 41 to a sidewall panel 50, with each edge 52 of a sidewall panel 50 stitched along seam 41 to an adjoining triangular component 40, resulting in the four corner components 40 and the four sidewall panels 50 forming the four sidewalls of enclosed bag 10.

Figure 4:
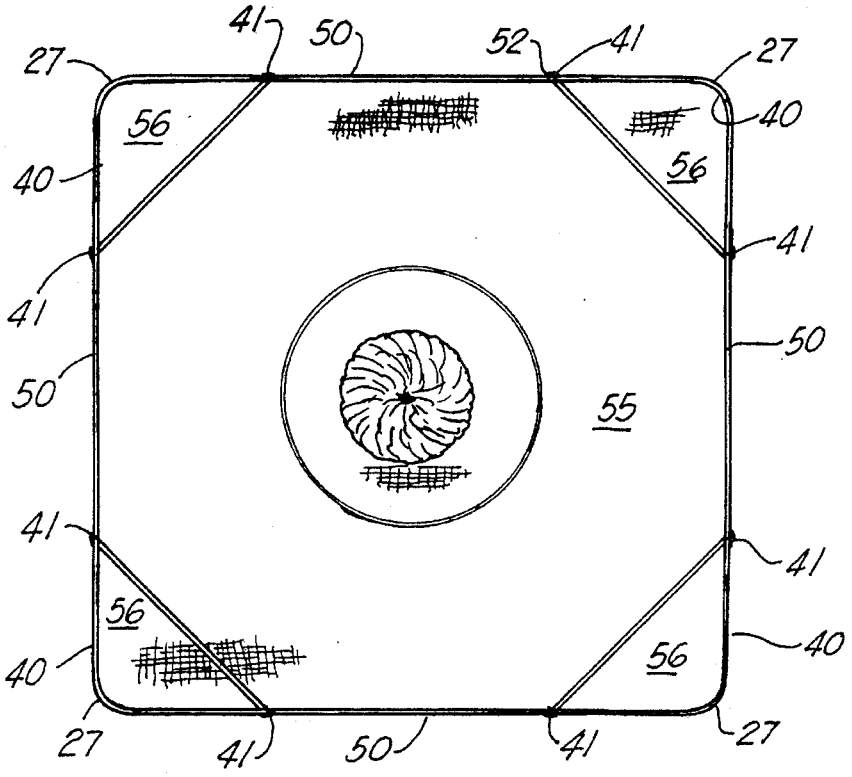
FIG. 4 illustrates a top view along lines 4—4 of FIG. 3.

Reference is now again made to FIG. 5 which illustrates the features of the third leg 46 of the triangular component 40 which serves as one of four internal baffle wall 48 of the bulk bag as illustrated in top view in FIG. 4. As seen in FIG. 4, each baffle wall 48 spans across each corner 27 of the bulk bag 10 and would in effect form a central interior space 55, which would normally be sealed off from each corner space 56 formed by the four baffle walls 48. In order to avoid this eventuality, reference is made to FIG. 5 where there are illustrated the means for allowing the bulk material 25 within the bag, poured through the entry spout 26, to move from the central interior space 55 within the bag 10 to each of the corner spaces 56 formed by the baffle walls 48. This means comprises a plurality of openings along the baffle wall 48 as seen in FIG. 4. There is first provided an upper generally rectangular opening 60, which is followed by a plurality of generally triangular shaped openings 62 spaced along the length of the baffle wall 48, and terminating in a lower generally rectangular opening 64. These openings would allow material to fill all corner spaces 56 within the interior of the bag, (arrows 61) and prevent the baffle wall 48 from interfering with the complete filling of the bag. As further illustrated, there is provided a width of fabric 65 between the openings along the baffle wall 48, with the width of fabric 65 serving as a means to provide sufficient strength along the length of the baffle wall 48, so that the baffle wall 48, weakened by the openings along it's length, does not tear, which would result in the bag losing its generally rectangular shape when filled with material.

Figure 3:
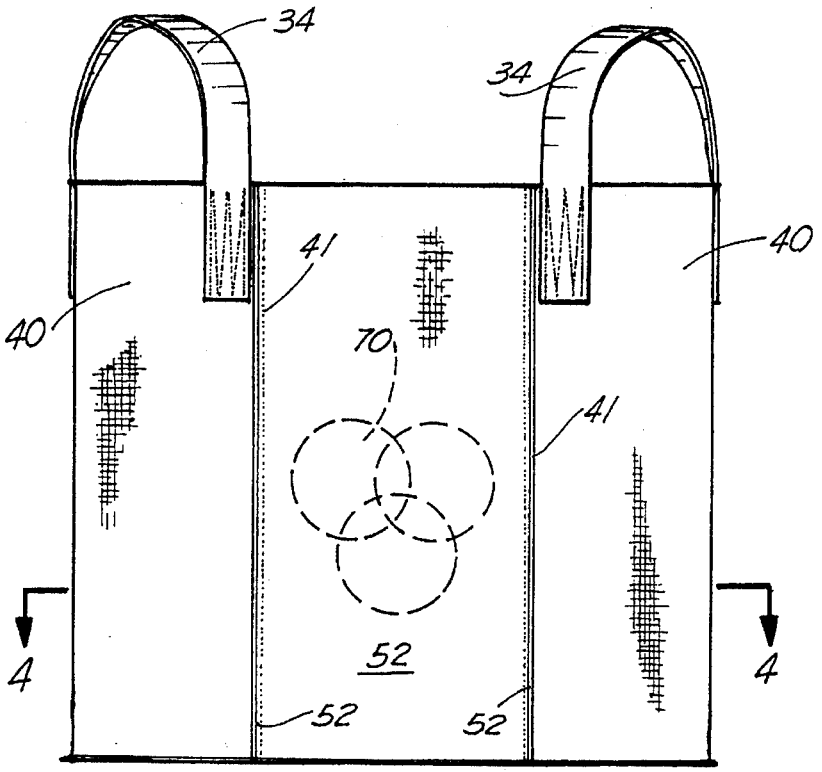
FIG. 3 illustrates a side view of one sidewall of the preferred embodiment of the improved baffled bulk bag of the present invention.

As was referred to earlier, since each sidewall 12, 14, 16, 18 of the bag 10 comprises in part a series of corner triangles 40 stitched to a series of fabric panels 50, this provides an additional feature of the bag. As seen in FIG. 3, when the panel 50 is stitched to its adjoining corner triangles 40, the panel 50 provides a central uninterrupted face 52 on each sidewall. That being the case, the panel 50, therefore, defines a means on each sidewall wherein a customer name or logo may be positioned without a seam running through the company name. As an example, a fictitious logo 70 is shown in phantom view in FIG. 3 which illustrates this important feature, not found in previous baffled bags.

Figure 6:
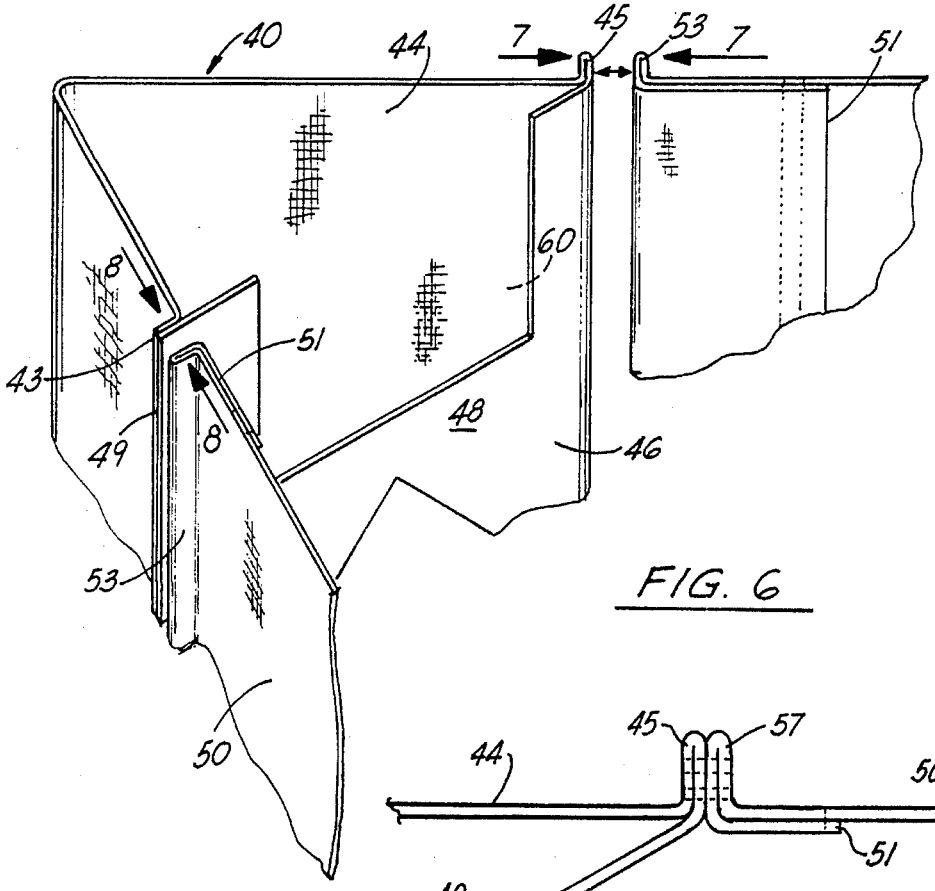
FIG. 6 illustrates a partial exploded view of the seam arrangements between the wall components of the preferred embodiment of the improved baffled bulk bag of the present invention.
Figure 7:
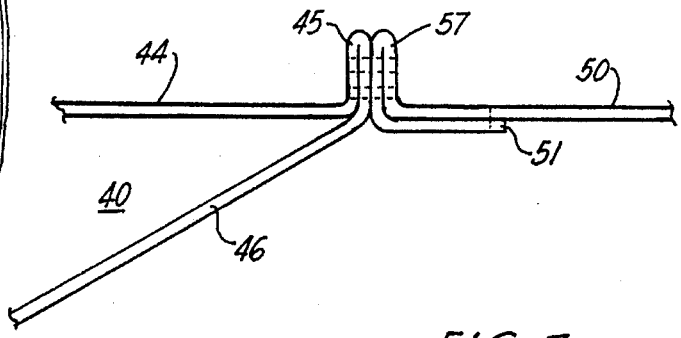
FIGS. 7 and 8 illustrate a detail view of the seams shown in arrows 7—7 and 8—8 in FIG. 6 respectively.
Figure 8:
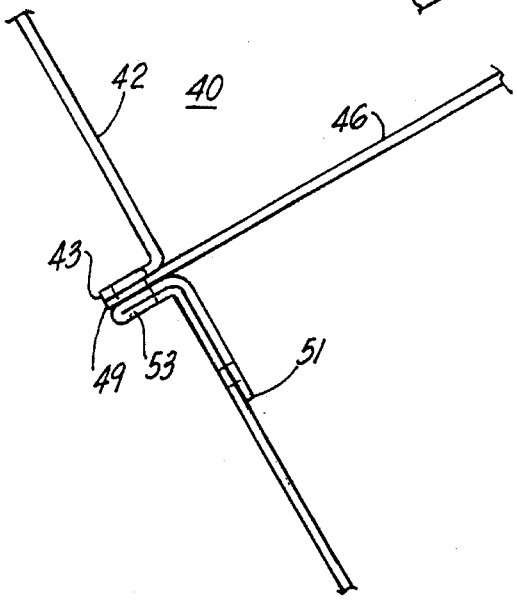

An additional important novel feature of the present invention is the manner in which the sidewalls 12, 14, 16, 18 of the bag are formed through stitching alternating panels 50 to adjoining corner triangles 40. As seen in FIG. 6, there is illustrated one of the fabric corner triangles 40 having its first leg 42, with a first edge 43, the first leg 42 continuing on to a the second leg 44 of the triangle, the end of the second leg 44 formed into a pleat 45, and continuing on to the third leg 46, or baffle wall portion 48 of the corner, which terminates in a second edge 49 of the triangular fabric corner 40, and would rejoin the first edge 43 of the fabric as illustrated. Next, a first edge 51 of central fabric panel 50 would be folded to form a pleat 53, which would be stitched to the first and second edges 43, 49 of triangular corner 40 as illustrated in FIG. 8. The pleat 45 formed between the second and third legs 44, 46 of the triangle 40 would be stitched to a pleat 53 formed in the edge 51 of a second central fabric panel 50, as seen in FIG. 7. This process would be repeated between each adjoining triangular corner 40 and each fabric panel 50 which would result in the panels and corner triangles sewn together to form the bag. Following this procedure, each end of the lifting loops 34 would be sewn to adjacent sidewalls, as illustrated, and the top and bottom would then be sewn onto the bag to complete the bag construction.

It is imperative to note that, unlike the prior art, the baffles formed in the bag's interior, are not formed simply from four panels of fabric sewn to straddle the corners in order to maintain the structural integrity of the bag. The baffles 48 are formed from one leg 46 of four corner triangle shaped pieces of fabric, and are integral to the construction to each corner of the bag. Because of this unique construction between the corners, and the positioning of the openings in the baffle wall to provide means for maintaining the strength of the baffle wall despite the openings, this configuration of the improved baffle bag allows the bag to have the overall structural integrity heretofore not found in baffle bags, and is a construction which is easy to undertake.

As was discussed earlier, utilizing baffles within certain types of bulk bags provides for maintaining greater structural integrity to the bags when they are filled with bulk material. Likewise, due to the sensitivity of some bulk material, is critical that the bag, including baffle bags, incorporate an internal polyethylene liner, so that the bulk material cannot come into contact with the fabric or with the outside world.

Applicant has received a patent on a glued in liner for a bulk bag, U.S. Pat. No. 4,946,291, with the liner being allowed to adhere to the inner wall of the bag through at least one glue line formed between the liner and the bag. With that process in mind, the improved baffle bulk bag may incorporate a liner in the bag. However, since the bag must include baffle features to remain structurally intact, reference is made to FIG. 9 which illustrates a bulk material bag 100, having a substantially rectangular shape, with four side walls 102, 104, 106, 108. There are included a plurality of lifting loops 110 at each corner 112 of the bag 100 to provide a means for lifting a filled bag. However, in order to maintain the structural integrity of the bag, and to accommodate the features of a bag having a liner, there is provided a liner means 120. Liner means 120 would be constructed of polyethylene material, and would be constructed in the manner of the baffle bag 10 as discussed previously, in the discussion of the construction of the baffled bag 10, itself, as shown in FIGS. 1 through 8. That is, there would be provided the four corner triangular corners 40 formed of polyethylene material, and formed in the matter as fabric bag 10. However, rather than having stitching to form the corners 40, the polyethylene would be formed by fusing the material to form a sealed seam, a process known in the industry. The corners 40 would then be sealed to a plurality of upright central panels 50, again constructed of polyethylene, to form the completed baffled liner means 120 as illustrated in FIG. 8. The liner means 120 would then be lowered into the space 24 of outer fabric bag 110, and at least one glue line 125, (See FIG. 10) or perhaps several, would be provided between the liner 120 and the outer fabric bag 10. Therefore, the glued in liner 120 would then give the fabric bag portion 10 the structural integrity due to the polyethylene baffles 48 incorporated into the liner 120, and it would also serve to properly line the bag against bulk material contamination. This method of constructing the liner within the bag would offer the option of utilizing a baffle bag incorporating a baffled liner, which is novel in the art.

In summary, the present invention takes the most common sizes of fabric i.e. 42 inches wide, and forms a triangle whose sides are equal to the height of the bag. The triangle is a right angle triangle whose sides form the corner of the bag and whose hypotenuse forms the bridge panels. Using wide belting, the lifting loops can be attached to the fabric on the sides of the triangle in any position. The preferred position is off the corners to allow easy access to the forklift tines. But this construction allows the placement to be squarely on the corners it desired. A separate center panel would connect each of the four corners to complete the sides. By using a separate center panel, as indicated earlier, any printing can be done on the center panel. The entire bag can be created in pieces and put together on a standard assembly line requiring no special equipment. For example, if a rectangular bag is required, two of the center panels can be sized differently to create the desired shape, but the methods of construction remain completely unchanged. The bridge panel, corner triangle can be made of tubular construction. Either flat or circular fabrics can be reinforced fabrics for stronger lift.

| Glossary of Terms | |
|---|---|
| bulk bag | 10 |
| wall portions | 12, 14, 16, 18 |
| top portion | 20 |
| bottom portion | 22 |
| internal bag space | 24 |
| bulk material | 25 |
| entry spout | 26 |
| corner | 27 |
| fabric | 28 |
| discharge spout | 30 |
| lifting loops | 34 |
| end portions | 35 |
| fabric corner component | 36 |
| triangle configuration | 40 |
| first seam | 41 |
| first leg | 42 |

-continued

| Glossary of Terms | |
|---|---|
| first edge | 43 |
| second leg | 44 |
| pleat | 45 |
| third leg | 46 |
| internal baffle wall component | 48 |
| second edge | 49 |
| sidewall panel | 50 |
| first edge | 51 |
| central face | 52 |
| pleat | 53 |
| central space | 55 |
| corner spaces | 56 |
| pleat | 57 |
| openings | 58 |
| rectangular opening | 60 |
| arrows | 61 |
| triangular opening | 62 |
| lower rectangular opening | 64 |
| width of fabric | 65 |
| logo | 70 |
| bag | 100 |
| sidewalls | 102, 104, 106, 108 |
| lifting loops | 110 |
| corner | 112 |
| liner means | 120 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved bulk material fabric transport bag, comprising:

a) four first panels of fabric, each of said panels having a first edge and a second edge, and positioned to form and define a corner of said bag, such that a first portion of each fabric panel defines a portion of one bag wall, a second portion of each fabric panel defines a portion of a second bag wall, and a third portion of the panel folded so that the second edge of said fabric panel interconnects to the first edge of the panel, the third portion defining an interior baffle member straddling each corner of the bag, the three of said portions of the fabric panel defining together a substantially triangular fabric configuration;

b) second panels of fabric sewn intermediate two adjacent corner panels, each said second panel fabric together with the four corner panels defining the interior space of the bag when the intermediate panels are interconnected with each corner panel; and c) a plurality of triangular-shaped openings formed in each of the third portions of the corner panels defining the interior baffle members of the bag for allowing material to flow through the baffle members and for providing strength to the bag when the bag is filled with bulk material, wherein the triangular-shaped openings are spaced along the length of the baffle members, each opening being spaced sufficiently apart from an adjacent opening to provide a fabric bridge sufficient to withstand the force of bulk material filling the bag.

2. The material fabric bag in claim 1, wherein each of the four corner panels are formed from material 42 inches in width.

3. The material fabric bag in claim 1, wherein there is further included a top and bottom portion of the bag sewn onto the walls of the bag.

4. The material fabric bag in claim 3, wherein the top wall and bottom portions of the bag include an entry spout and discharge spout respectively.

5. The material fabric bag in claim 1, further comprising a plurality of lifting loops sewn at each corner of the bag.

6. An improved bulk material transport bag, having a plurality of sidewalls, a top portion, a bottom portion, an entry spout and a discharge spout, and a lifting loop formed at each corner of the bag, said bag comprising:

a) four first panels of fabric, each of said first panels having a first edge and a second edge, and positioned to form a corner of said bag, such that a first portion of each first fabric panel defines a portion of one of a plurality of sidewalls, a second portion of each first fabric panel defines a portion of a second of a plurality of sidewalls, and a third portion of each of said first panels folded so that the second edge of each of said fabric panels interconnects to the first edge of each of said first panels, the third portion defining an interior baffle member straddling each corner of the bag, the three of said portions of each of said first fabric panels each defining a substantially triangular fabric configuration at each of said corners of said bag;

b) second panels of fabric sewn intermediate two adjacent triangular configured corner panels, each said second panel fabric together with the four triangular configured corner panels defining the interior space of the bag when the intermediate panels are interconnected with each triangular configured corner panel; and c) a plurality of triangular-shaped openings formed in each of the portions of the corner panels defining the interior baffle members of the bag for allowing material to flow through the baffle members and for providing strength to the bag when the bag is filled with bulk material, wherein the triangular-shaped openings are spaced along the length of the baffle members, each opening being spaced sufficiently apart from an adjacent opening to provide a fabric bridge sufficient to withstand the force of bulk material filling the bag.

7. A fabric bulk material transport bag, comprising:

a) a plurality of sidewalls, a top portion, a bottom portion, an entry spout and a discharge spout, and a lifting loop formed at each corner of the bag;

b) a polyethylene liner positioned within the bag, said liner comprising:

i) four first panels of polyethylene material, each of said first panels having a first edge and a second edge, and positioned to form a corner of said liner, such that a first portion of each first panel defines a portion of one of plurality of sidewalls of said liner, a second portion of each first panel defines a portion of a second of plurality of sidewalls, and a third portion of each of said first panels folded so that the second edge of each of said panels being fused to the first edge of each of said first panels, and the third portion defines an interior baffle member straddling each corner of the liner, the three of said portions of each of said first panels each defining a substantially triangular configuration at each of said corners of said liner;

ii) second panels of polyethylene positioned intermediate two adjacent triangular configured corner panels, each said second polyethylene panel together with the four triangular configured corner panels defining the interior space of the liner when the intermediate panels are interconnected with each triangular configured corner panel; and (iii) a plurality of triangular-shaped openings formed in each of the portions of the corner panels defining the interior baffle members of the liner for allowing material to flow through the baffle members, said liner positionable within the fabric bag and adhered to the inner wall of the fabric bag, so that the fabric bag is provided with an internal liner which provides structural integrity to the bag and a contamination-free environment for bulk material poured into the bag.

8. The bulk material transport bag of claim 7, wherein said liner is adhered to the inner wall of the fabric bag via gluing.

9. The bulk material transport bag of claim 7, wherein the triangular-shaped openings are spaced along the length of the baffle members, each opening being placed sufficiently apart from an adjacent opening to provide a polyethylene bridge sufficient to withstand the force of bulk material filling the bag.

10. A polyethylene liner for positioning within a fabric bulk material transport bag having a plurality of sidewalls, a top portion, a bottom portion, an entry spout and a discharge spout, and a lifting loop formed at each corner of the bag, the polyethylene liner comprising:

a) four first panels of polyethylene material, each of said first panels having a first edge and a second edge, and positioned to form a corner of said liner, such that a first portion of each first panel defines a portion of one of plurality of sidewalls of said liner, a second portion of each first panel defines a portion of a second of plurality of sidewalls, and a third portion of each of said first panels folded so that the second edge of each of said panels being fused to the first edge of each of said first panels, the third portion defining an interior baffle member straddling each corner of the liner, the three of said portions of each of said first panels each defining a substantially triangular configuration at each of said corners of said liner;

b) second panels of polyethylene positioned intermediate two adjacent triangular configured corner panels, each said second polyethylene panel together with the four triangular configured corner panels defining the interior space of the liner when the intermediate panels are interconnected with each triangular configured corner panel; and c) a plurality of triangular-shaped openings formed in each of the third portions of the corner panels defining the interior baffle members of the liner for allowing material to flow through the baffle members, said liner positionable within the fabric bag and adherable to the inner wall of the fabric bag, so that the fabric bag is provided with an internal liner which provides structural integrity to the bag and a contamination-free environment for bulk poured into the bag.

11. The liner of claim 10, wherein said liner is adherable to the inner wall of the fabric bag via gluing.

12. The liner of claim 10, wherein the triangular-shaped openings are spaced along the length of the baffle members, each opening being spaced sufficiently apart from an adjacent opening to provide a polyethylene bridge sufficient to withstand the force of bulk material filling the bag.

* * * * *